US008789511B2

(12) United States Patent
Sakata

(10) Patent No.: US 8,789,511 B2
(45) Date of Patent: Jul. 29, 2014

(54) CONTROLLER FOR PRESSURE REDUCING VALVE

(75) Inventor: Masakazu Sakata, Obu (JP)

(73) Assignee: Denso Corporation, Kariya (JP)

( * ) Notice: Subject to any disclaimer, the term of this patent is extended or adjusted under 35 U.S.C. 154(b) by 484 days.

(21) Appl. No.: 13/211,551

(22) Filed: Aug. 17, 2011

(65) Prior Publication Data

US 2012/0042853 A1 Feb. 23, 2012

(30) Foreign Application Priority Data

Aug. 18, 2010 (JP) ..... 2010-182949

(51) Int. Cl.
*F02M 1/00* (2006.01)
*F02D 41/38* (2006.01)
*F02D 41/24* (2006.01)

(52) U.S. Cl.
CPC ..... *F02D 41/2451* (2013.01); *F02D 41/3863* (2013.01)
USPC ..... 123/456; 123/459

(58) Field of Classification Search
CPC ..... F02M 55/015; F02M 55/007
USPC ..... 123/445, 446, 456, 457, 459, 510, 511
See application file for complete search history.

(56) References Cited

U.S. PATENT DOCUMENTS 7,848,868 B2 12/2010 Nakagawa et al.
7,861,691 B2 1/2011 Nakata et al.
7,873,460 B2 * 1/2011 Nakata et al. ..... 701/103
8,014,932 B2 9/2011 Nakata et al.
2008/0228374 A1 9/2008 Ishizuka et al.

FOREIGN PATENT DOCUMENTS

JP P2003-314331 A 11/2003
JP P2003-343330 A 12/2003
JP 2008-274842 11/2008

OTHER PUBLICATIONS

Japanese Office Action dated Jun. 26, 2012, issued in corresponding Japanese Application No. 2010-182949 with English translation.
Office Action (5 pages) dated Nov. 21, 2013, issued in corresponding Chinese Application No. 201110236641.3 and English translation (5 pages).

* cited by examiner

*Primary Examiner* — John Kwon
(74) *Attorney, Agent, or Firm* — Nixon & Vanderhye PC

(57) ABSTRACT

A controller for a pressure reducing valve is applied to a fuel injection system which is provided with a pressure reducing valve in a common-rail and a fuel pressure sensor detecting a fuel pressure in a fuel supply passage from the accumulator to an injection port of the fuel injector. The controller includes a fuel-pressure-variation detector for detecting a fuel pressure variation timing at which a detection value of the fuel pressure sensor is varied due to an opening operation or a closing operation of the pressure reducing valve. The controller further includes a response-delay-time computing portion for computing a response delay time of the pressure reducing valve based on a command timing and a fuel pressure variation timing.

6 Claims, 5 Drawing Sheets

FIG. 2A
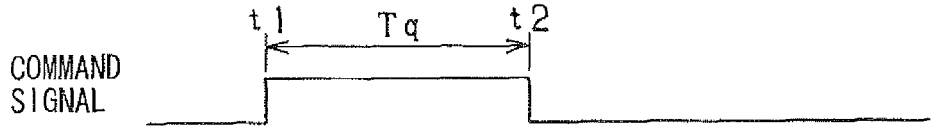
FIG. 2B
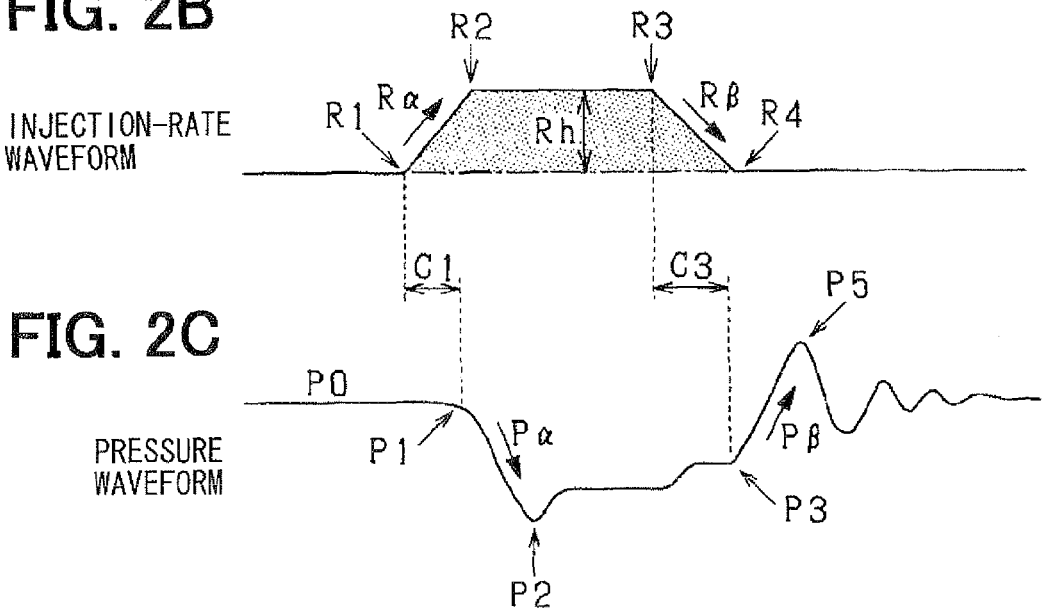
FIG. 2C

COMMON-RAIL PRESSURE
TH1
t10
Pact
t20
Ptrg
TH2

COMMAND SIGNAL
OPEN VALVE
CLOSE VALVE

PRESSURE REDUCING VALVE
FULL OPEN
FULL CLOSE
M1
M5
t11
N1
N5
t21

P (#2)
M2
t12
N2
t22
M4
M3
N4
N3

P (#4)
t13
t23

CONTROLLER FOR PRESSURE REDUCING VALVE

CROSS-REFERENCE TO RELATED APPLICATION

This application is based on Japanese Patent Application No. 2010-182949 filed on Aug. 18, 2010, the disclosure of which is incorporated herein by reference.

FIELD OF THE INVENTION

The present invention relates to a control apparatus which controls an operation of a pressure reducing valve. The pressure reducing valve reduces fuel pressure in an accumulator.

BACKGROUND OF THE INVENTION

Generally, in a fuel injection system for an internal combustion engine, the fuel supplied from a fuel pump is accumulated in a common-rail (accumulator) and then supplied to each fuel injector. JP-2008-274842A describes that a pressure reducing valve is opened to reduce the fuel pressure in the common-rail when the fuel pressure in the common-rail exceeds a target pressure. When the fuel pressure in the common-rail becomes lower than or equal to the target pressure, the pressure reducing valve is closed.

However, a time lag (response delay time) exists from the time when a command signal is generated to open or close the pressure reducing valve until the time when the pressure reducing valve is actually operated. Thus, it is necessary to control the pressure reducing valve in view of the time lag. However, a method for accurately detecting the response delay time has not been proposed.

SUMMARY OF THE INVENTION

The present invention is made in view of the above matters, and it is an object of the present invention to provide a controller for a pressure reducing valve, which enables to accurately detect a response delay time of a pressure reducing valve and accurately control fuel pressure in an accumulator.

According to the present invention, a controller for pressure reducing valve is applied to a fuel injection system which is provided with an accumulator accumulating a fuel which is supplied from a fuel pump to a fuel injector, a pressure reducing valve reducing an internal fuel pressure in the accumulator, and a fuel pressure sensor detecting a fuel pressure in a fuel supply passage from the accumulator to an injection port of the fuel injector.

The controller controls an operation of the pressure reducing valve in such a manner that the internal fuel pressure in the accumulator agrees with a target fuel pressure. The controller includes: a fuel-pressure-variation detecting means for detecting a fuel pressure variation timing at which a detection value of the fuel pressure sensor is varied due to an opening operation or a closing operation of the pressure reducing valve; and a response-delay-time computing means for computing a response delay time from a time when a command signal is outputted until a time when the pressure reducing valve start opening or closing, based on a command timing at which the command signal is outputted to open or close the pressure reducing valve and the fuel pressure variation timing detected by the fuel-pressure-variation detecting means.

Since the fuel pressure variation timing and the response delay time of the pressure reducing valve have high correlation therebetween, the response delay timing can be computed with high accuracy based on the fuel pressure variation timing.

According to the present invention, the fuel pressure variation timing is detected by means of the fuel pressure sensor and the response delay time of the pressure reducing valve is computed based on the fuel pressure variation timing and the command timing, whereby the response delay time of the pressure reducing valve can be detected with high accuracy. Thus, the pressure reducing valve can be controlled in view of the response delay time, and the interior pressure of the accumulator can be accurately controlled.

BRIEF DESCRIPTION OF THE DRAWINGS

Other objects, features and advantages of the present invention will become more apparent from the following description made with reference to the accompanying drawings, in which like parts are designated by like reference numbers and in which:

FIG. 2A is a chart showing a fuel-injection-command signal to a fuel injector;

FIG. 2B is a chart showing an injection-rate waveform indicative of a variation in fuel injection rate;

FIG. 2C is a chart showing a pressure waveform based on detection values of a fuel pressure sensor;

DETAILED DESCRIPTION OF EMBODIMENTS

Figure 1:
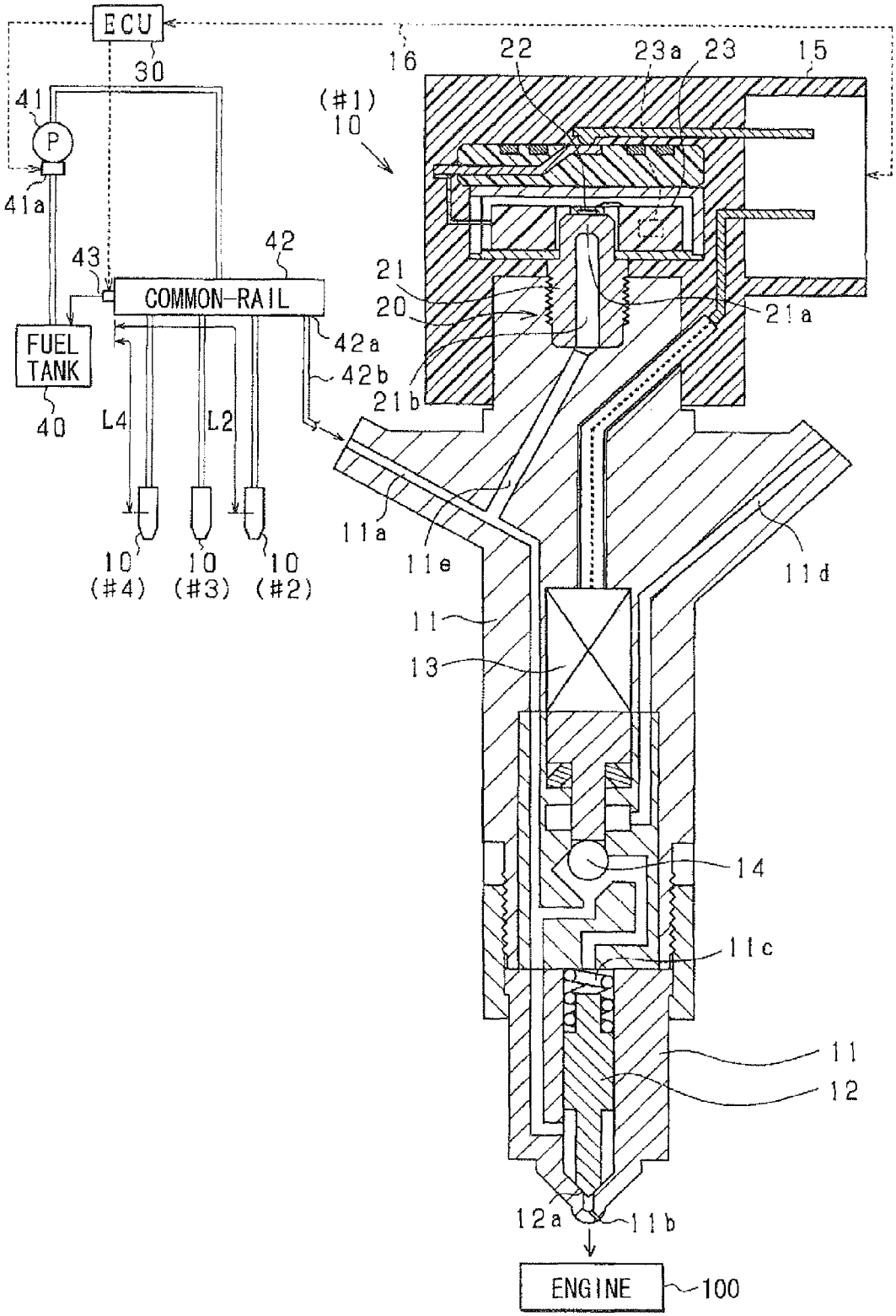
FIG. 1 is a construction diagram showing an outline of a fuel injection system on which a pressure reducing valve controller is mounted, according to a first embodiment of the present invention.

Hereafter, embodiments of the present invention will be described. The same parts and components as those in each embodiment are indicated with the same reference numerals and the same descriptions will not be reiterated.

[First Embodiment]

A fuel-injection condition detector is applied to an internal combustion engine (diesel engine) having four cylinders #1-#4.

FIG. 1 is a schematic view showing fuel injectors 10 provided to each cylinder, a fuel pressure sensor 20 provided to each fuel injectors, an electronic control unit (ECU) 30 and the like.

First, a fuel injection system of the engine including the fuel injector 10 will be explained. A fuel in a fuel tank 40 is pumped up by a high-pressure pump 41 and is accumulated in a common-rail (accumulator) 42 to be supplied to each fuel injector 10 (#1-#4). The fuel injectors 10 (#1-#4) perform fuel injection sequentially in a predetermined order. The high-pressure pump 41 is a plunger pump which intermittently discharges high-pressure fuel.

The fuel injector 10 is comprised of a body 11, a needle valve body 12, an actuator 13 and the like. The body 11 defines a high-pressure passage 11*a* and an injection port 11*b*. The needle valve body 12 is accommodated in the body 11 to open/close the injection port 11*b*.

The body 11 defines a backpressure chamber 11*c* with which the high pressure passage 11*a* and a low pressure passage lid communicate. A control valve 14 switches between the high pressure passage 11*a* and the low pressure passage lid, so that the high pressure passage 11*a* communicates with the backpressure chamber 11*c* or the low pressure passage 11*d* communicates with the backpressure chamber 11*c*. When the actuator 13 is energized and the control valve 14 moves downward in FIG. 1, the backpressure chamber 11*c* communicates with the low pressure passage 11*d*, so that the fuel pressure in the backpressure chamber 11*c* is decreased. Consequently, the back pressure applied to the valve body 12 is decreased so that the valve body 12 is opened. Meanwhile, when the actuator 13 is deenergized and the control valve 14 moves upward, the backpressure chamber 11*c* communicates with the high pressure passage 11*a*, so that the fuel pressure in the backpressure chamber 11*c* is increased. Consequently, the back pressure applied to the valve body 12 is increased so that the valve body 12 is closed.

The ECU 30 controls the actuator 13 to drive the valve body 12. When the needle valve body 12 opens the injection port 11*b*, high-pressure fuel in the high pressure passage 11*a* is injected to a combustion chamber (not shown) of the engine through the injection port 11*b*. The ECU 30 computes a target fuel-injection condition, such as a fuel-injection-start timing, a fuel-injection-end timing, a fuel injection quantity and the like based on an engine speed, an engine load and the like. The ECU 30 transmits a fuel-injection-command signal to the actuator 13 in order to drive the needle valve body 12 in such a manner as to obtain the above target fuel-injection condition.

The ECU 30 has a microcomputer which computes the target fuel-injection condition based on the engine load and the engine speed, which are derived from an accelerator position. For example, the microcomputer stores an optimum fuel-injection condition (number of stages of fuel injection, fuel-injection-start timing, fuel-injection-end timing, fuel injection quantity and the like) with respect to the engine load and the engine speed as a fuel-injection condition map. Then, based on the current engine load and engine speed, the target fuel-injection condition is computed in view of the fuel-injection condition map. Then, based on the computed target fuel-injection condition, the fuel-injection-command signal represented by "t1", "t2", "Tq" is established as shown in FIG. 2A. For example, the fuel-injection-command signal corresponding to the target fuel-injection condition is stored in a command map. Based on the computed target fuel-injection condition, the fuel-injection-command signal is established in view of the command map. As above, according to the engine load and the engine speed, the fuel-injection-command signal is established to be output from the ECU 30 to the injector 10.

It should be noted that the actual fuel-injection condition varies relative to the fuel-injection-command signal due to aging deterioration of the fuel injector 10, such as abrasion of the injection port 11*b*. Thus, the injection-rate waveform is computed based on the pressure waveform detected by the fuel pressure sensor 20, so that the fuel-injection condition is detected. A correlation between the detected fuel-injection condition and the fuel-injection-command signal (pulse-on timing t1, pulse-off timing t2, and pulse-on period Tq) is learned. Based on this learning result, the fuel-injection-command signal stored in the command map is corrected. Thus, the fuel-injection condition can be accurately controlled so that the actual fuel-injection condition agrees with the target fuel-injection condition.

A structure of the fuel pressure sensor 20 will be described hereinafter. The fuel pressure sensor 20 includes a stem (load cell), a pressure sensor element 22 and a molded IC 23. The stem 21 is provided to the body 11. The stem 21 has a diaphragm 21*a* which elastically deforms in response to high fuel pressure in the high-pressure passage 11*a*.

The pressure sensor element 22 is disposed on the diaphragm 21*a* to output a pressure detection signal depending on an elastic deformation of the diaphragm 21*a*.

The molded IC 23 includes an amplifier circuit which amplifies a pressure detection signal transmitted from the pressure sensor element 22 and includes a transmitting circuit 23*a* which transmits the pressure detection signal. A connector 15 is provided on the body 11. The molded IC 23, the actuator 13 and the ECU 30 are electrically connected to each other through a harness 16 connected to the connector 15. The amplified pressure detection signal is transmitted to the ECU 30. Such a signal communication processing is executed with respect to each cylinder.

When the fuel injection is started, the fuel pressure in the high-pressure passage 11*a* starts decreasing. When the fuel injection is terminated, the fuel pressure in the high-pressure passage 11*a* starts increasing. That is, a variation in the fuel pressure and a variation in the injection rate have a correlation, so that the variation in the injection rate (actual fuel-injection condition) can be detected from the variation in the fuel pressure. The fuel-injection-command signal is corrected so that the detected actual fuel-injection condition agrees with the target fuel-injection condition. Thereby, the fuel-injection condition can be controlled with high accuracy.

Referring to FIGS. 2A to 2C, a correlation between the pressure waveform detected by the fuel pressure sensor 20 and the injection-rate waveform will be explained, hereinafter.

FIG. 2A shows a fuel-injection-command signal which the ECU 30 outputs to the actuator 13. Based on this fuel-injection-command signal, the actuator 13 operates to open the injection port 11*b*. That is, a fuel injection is started at a pulse-on timing "t1" of the injection-command signal, and the fuel injection is terminated at a pulse-off timing "t2" of the injection-command signal. During a time period "Tq" from the timing "t1" to the timing "t2", the injection port 11*b* is opened. By controlling this time period "Tq", the fuel injection quantity "Q" is controlled.

FIG. 2B shows an injection-rate waveform representing a variation in fuel injection rate, and FIG. 2C shows a pressure waveform representing a variation in detection pressure detected by the fuel pressure sensor 20.

Since the pressure waveform and the injection-rate waveform have a correlation which will be described below, the injection-rate waveform can be estimated from the detected pressure waveform. That is, as shown in FIG. 2A, after the injection command signal rises at the timing "t1", the fuel injection is started and the injection rate starts increasing at a timing "R1". When a delay time "Cl" has elapsed after the timing "R1", the detection pressure starts decreasing at a point "P1". Then, when the injection rate reaches the maximum injection rate at a timing "R2", the detection pressure drop is stopped at a point "P2". Then, when a delay time "c3" has passed after the injection rate starts decreasing at the timing "R3", the detection pressure starts increasing at the point "P3". After that, when the injection rate becomes zero and the actual fuel injection is terminated at a timing "R4", the increase in the detection pressure is stopped at the point "P5".

As explained above, the pressure waveform and the injection-rate waveform has a high correlation. Since the injection-rate waveform represents the fuel-injection-start timing (R1), the fuel-injection-end timing (R4) and the fuel injection quantity (area of shade portion in FIG. 2B), the fuel injection condition can be detected by estimating the injection-rate waveform from the pressure waveform. It should be noted that the ECU 30 functions as a pressure waveform generating means and an injection-rate computing means.

A common-rail pressure control will be described hereinafter. In this common-rail pressure control, the fuel pressure in the common-rail 42 is controlled in such a manner as to agree with a target common-rail pressure. The fuel pressure in the common-rail is referred to as a common-rail pressure.

A pressure reducing valve 43 is provided to the common-rail 42. When the pressure reducing valve 43 is opened, the fuel in the common-rail 42 is returned into the fuel tank 40, so that the common-rail pressure is decreased. When an electromagnetic solenoid (not shown) of the pressure reducing valve 43 is energized, the pressure reducing valve 43 is opened. When deenergized, the pressure reducing valve 43 is closed. The energization condition of the pressure reducing valve 43 is controlled by the ECU 30. Thus, when it is necessary to decrease the common-rail pressure, the ECU 30 opens the pressure reducing valve 43 so that the fuel in the common-rail 42 is returned to the fuel tank 40.

A high-pressure pump 41 is provided with a metering valve 41*a*. The ECU 30 controls the metering valve 41*a* so that the discharge quantity of the high-pressure pump 41 is varied. Thus, when it is necessary to increase the common-rail pressure, the ECU 30 closes the pressure reducing valve 43 and increases the discharge quantity of the high-pressure pump 41.

Figure 3:
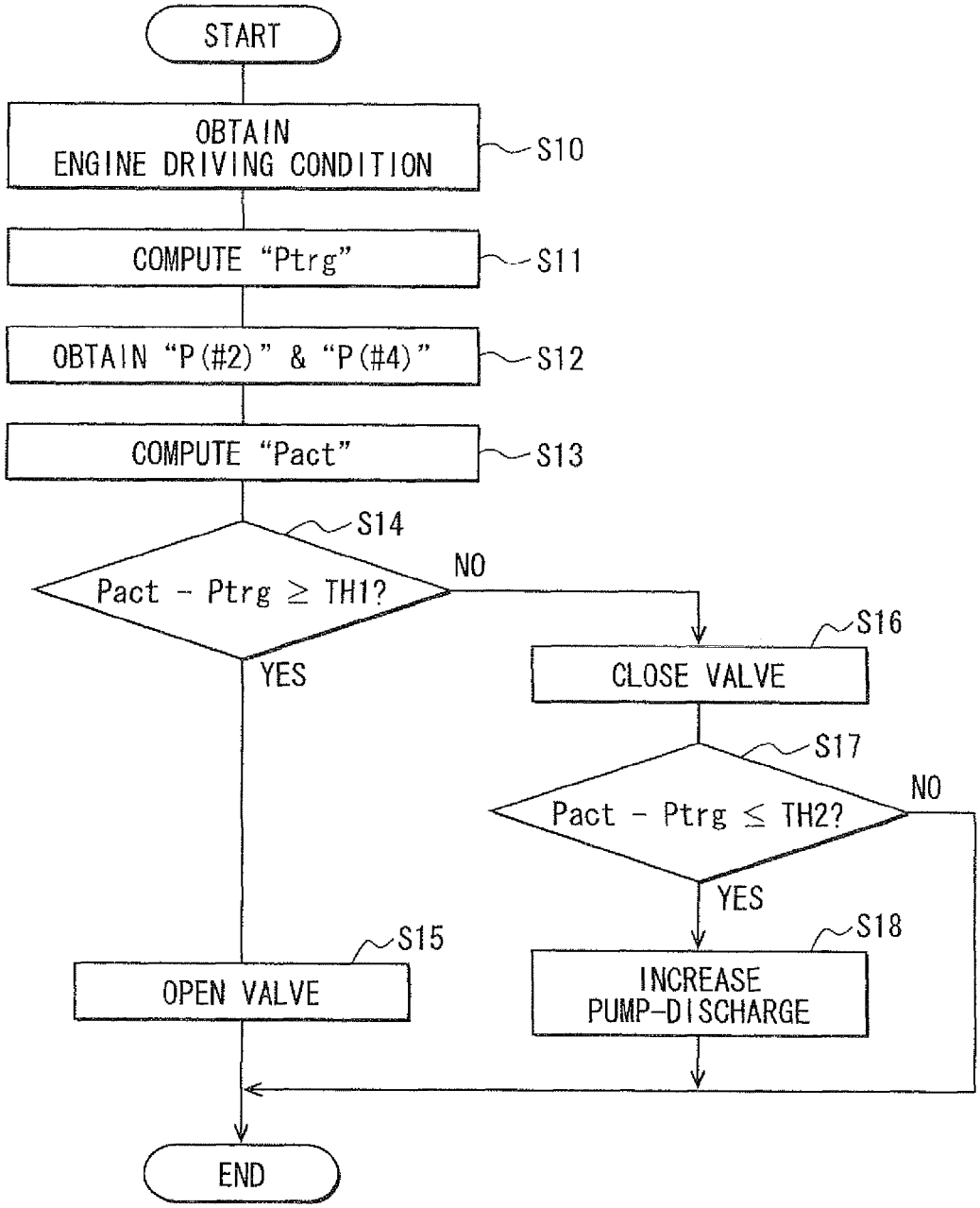
FIG. 3 is a flowchart showing a processing for controlling a common-rail pressure according to the first embodiment.

FIG. 3 is a flowchart showing a processing for controlling the common-rail pressure. A microcomputer of the ECU 30 repeatedly executes the processing at specified intervals.

In step S10, the engine driving condition, such as an engine speed and an engine load, is obtained. In step S11, the computer computes a target common-rail pressure "Ptrg" based on the obtained engine driving condition. For example, as the engine speed and the engine load are higher, the target common-rail pressure "Ptrg" is higher.

In step S12, the computer obtains a detection value of the fuel pressure sensor 20 which is provided to a non-injection cylinder. In the present embodiment, when a fuel injection is conducted in a first cylinder #1, no fuel injection is conducted in a second and a third cylinder #2, #3. Thus, in step S12, the computer obtains detection values of the fuel pressure sensors 20 provided to the second and the third cylinder #2, #3.

In step S13, based on the detected fuel pressure "P(#2)", "P(#4)" obtained in step S12, an actual common-rail pressure "Pact" is computed. For example, an average of detected fuel pressure "P(#2)" and "P(#4)" can be established as the actual common-rail pressure "Pact". Alternatively, a single detected fuel pressure "P(#2)" can be established as the actual common-rail pressure "Pact". Alternatively, an average of the detected fuel pressure "P(#2)" in a specified period can be established as the actual common-rail pressure "Pact".

Figures 4A, 4B, 4C, 4D, 4E:
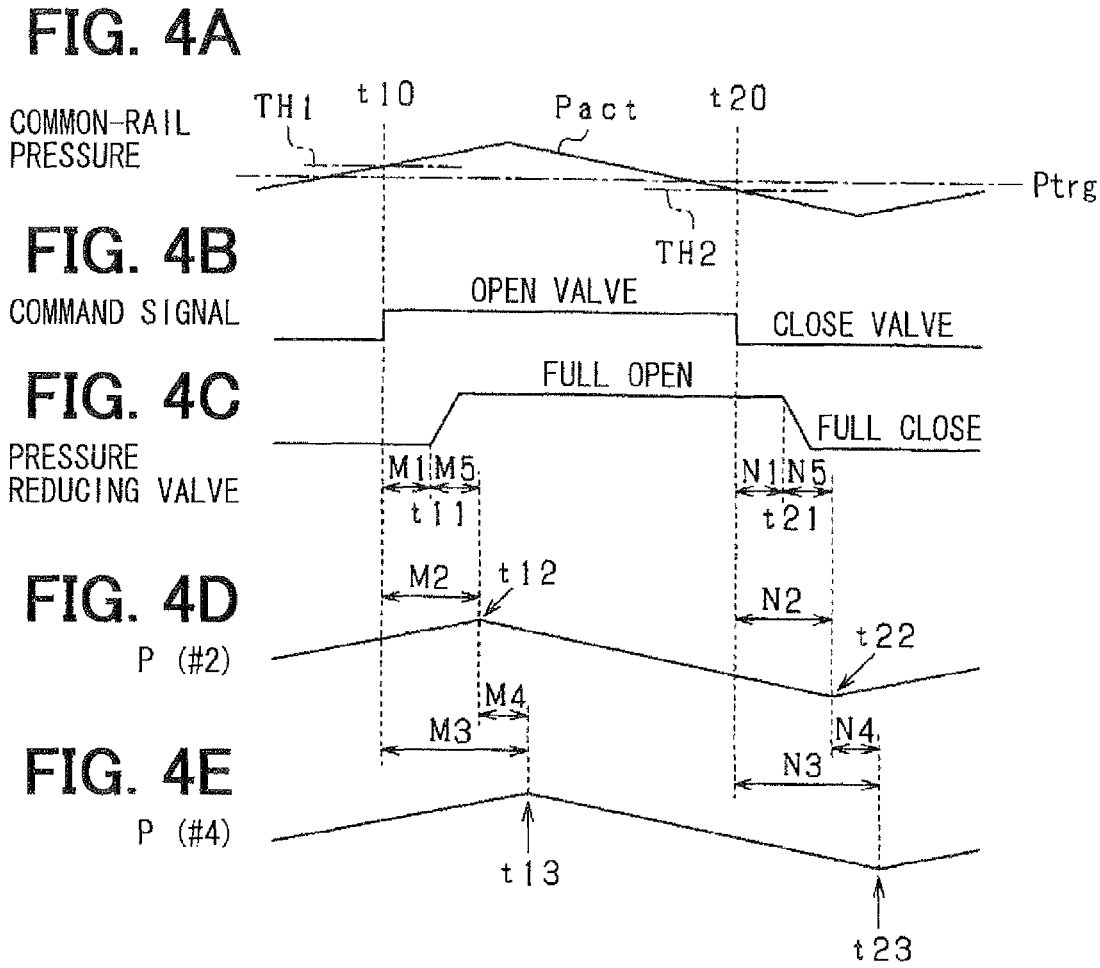
FIGS. 4A to 4E are time charts for explaining a response delay time of a pressure reducing valve in a case that a command signal is outputted to open or close the pressure reducing valve.

In step S14, the computer computes a deviation (Pact−Ptrg) between the actual common-rail pressure "Pact" and the target common-rail pressure "Ptrg", and then determines whether the deviation (Pact−Ptrg) is greater than or equal to a threshold "TH1" (refer to FIG. 4A). When the answer is YES in step S14, the procedure proceeds to step S15 in which the pressure reducing valve 43 is opened. Thereby, the actual common-rail pressure "Pact" is decreased.

When the answer is NO in step S14, the procedure proceeds to step S16 in which the pressure reducing valve 43 is closed. Then, the procedure proceeds to step S17 in which the computer determines whether the deviation (Pact−Ptrg) is less than or equal to a threshold "TH2" (refer to FIG. 4A). When the answer is YES in step S17, the procedure proceeds to step S18 in which the metering valve 41*a* is operated to increase the discharge quantity of the high-pressure pump 41. Thereby, the actual common-rail pressure "Pact" is increased.

When the answer is NO in step S17, the metering valve 41*a* is operated so that the current discharge quantity of the high-pressure pump 41 is maintained. That is, when the actual common-rail pressure "Pact" is within a range from "TH2" to "TH1" relative to the target common-rail pressure "Ptrg", the pressure reducing valve 43 is closed to maintain the current discharge quantity of the high-pressure pump 41. As above, the actual common-rail pressure "Pact" is feedback-controlled in such a manner as to agree with the target common-rail pressure "Ptrg".

FIG. 4B shows a command signal which the ECU 30 outputs to the pressure reducing valve 43. FIG. 4C shows a position of the pressure reducing valve 43, and FIGS. 4D and 4E respectively show the detected fuel pressures "P(#2)" and "P(#4)". When the deviation "Pact−Ptrg" reaches the threshold "TH1" at a timing 110", the ECU 30 outputs an open-command signal to the pressure reducing valve 43. When a response delay time "M1" has passed from the timing "t10", the pressure reducing valve 43 starts opening at a timing "t11" (refer to FIG. 4C). When the pressure reducing valve 43 is opened to decrease the actual common-rail pressure "Pact", a slope of the fuel pressure waveform becomes smaller at timings "t12" and "t13" at which the fuel pressure drop is propagated to the diaphragm 21*a* of the fuel pressure sensors 20 provided to the second and fourth cylinder #2, #4 (refer to FIGS. 4D and 4E). In FIGS. 4D and 4E, the fuel pressure starts decreasing at the timings "t12" and "t13".

When the deviation "Pact−Ptrg" is decreased to the threshold "TH2" at a timing "t20", the ECU 30 outputs a close-command signal to the pressure reducing valve 43. When a response delay time "N1" has passed from the timing "t20", the pressure reducing valve 43 starts closing at a timing "t21" (refer to FIG. 4C). When the pressure reducing valve 43 is closed to increase the actual common-rail pressure "Pact", a slope of the fuel pressure waveform becomes larger at timings "t22" and "t23" at which the fuel pressure increase is propagated to the diaphragm 21*a* of the fuel pressure sensors 20 provided to the second and the fourth cylinder #2, #4 (refer to FIGS. 4D and 4E). In FIGS. 4D and 4E, the fuel pressure starts increasing at the timings "t22" and "t23".

Since FIGS. 4A to 4E show a case where the high-pressure pump 41 is operated to feed the fuel, the fuel pressure is increased immediately before the timings 112", "t13" and immediately after the timings "t22", "t23". Meanwhile, when the high-pressure pump 41 is stopped, the fuel pressure is not increase to be maintained at the current pressure immediately before the timings "t12", "t13" and immediately after the timings "t22", "t23". Thus, in this case, when the fuel pressure starts decreasing from a stable condition, the timings "t12", "t13" are detected as fuel pressure variation timings. Further, when the fuel pressure starts being stable from a decreasing condition, the timings "t22", "t23" are detected as the fuel pressure variation timings.

As above, a time lag (response delay time M1, N1) exists from the time when a command signal is generated to open or close the pressure reducing valve 43 at the timings "t10", "t20" until the time when the pressure reducing valve 43 is actually operated to be opened or closed. In view of the fact that the fuel pressure timings "t12", "t13" "t22", "t23" appear on the fuel pressure waveform along with the operation of the pressure reducing valve 43, the response delay times "M1" and "N1" are computed and learned according to a procedure shown in FIG. 5.

Figure 5:
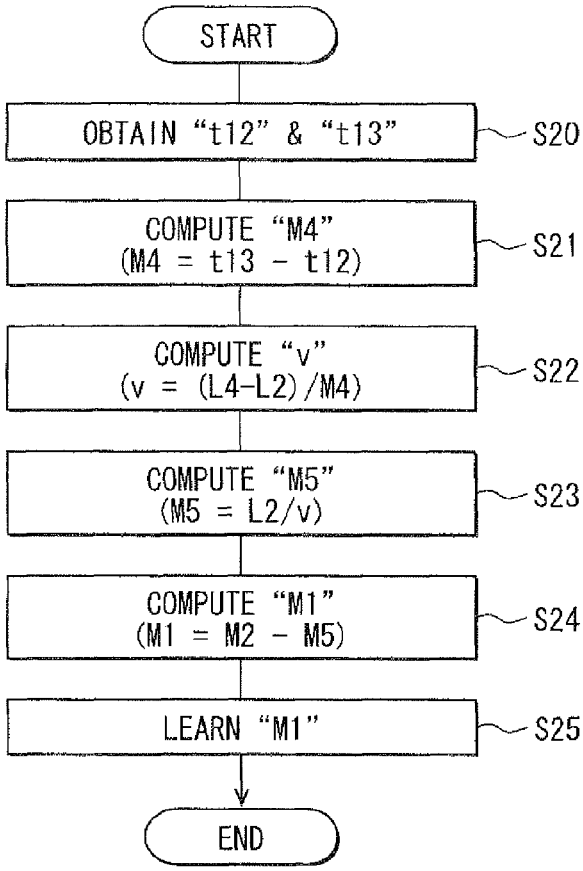
FIG. 5 is a flowchart showing a processing for computing the response delay time of the pressure reducing valve according to the first embodiment.

This processing shown in FIG. 5 is executed at a specified interval by a microcomputer of the ECU 30.

In step S20 (fuel pressure variation detecting means), the computer obtains a pressure waveform at the detected fuel pressures "P(#2)", "P(#4)" obtained in step S12. Then, the fuel-pressure-decrease-start timings "t12", "t13" are detected. For example, the differentiation value of the fuel pressure waveform is computed. When a variation in the differentiation value exceeds a specified value, the current timing is detected as the fuel-pressure-decrease-start timing "t12", "t13".

In step S21 (time difference computing means), a time difference "M4" between the timing "t12" and the timing "t13" computed (refer to FIG. 4E). In step S22 (propagation-velocity computing means), a fuel pressure propagation-velocity "v" is computed based on the time difference "M4" and a difference (L4−L2) between a passage length "L2" from the pressure reducing valve 43 to the #2 fuel pressure sensor 20 and a passage length "L4" from the pressure reducing valve 43 to the #4 fuel pressure sensor 20.

$$V=(L4-L2)/M4$$

The fuel supply passage length "L2" "L4" includes a length between the pressure reducing valve 43 and the discharge port 42*a* (#2, #4), a length of a high-pressure pipe 42*b* (#2, #4), a length of a high-pressure passage 11*a* in the body 11, and a length of an internal passage 21*b* in the stem 21. In the present embodiment, the fuel supply passage length has its own value with respect to each cylinder (#1-#4). These fuel supply passage lengths have been previously measured and are stored in the ECU 30.

In step S23 (propagation delay computing means), the computer computes a propagation delay time "M5" which is required for the variation in fuel pressure to be propagated from the pressure reducing valve 43 to the fuel pressure sensor 20 (#2), based on the fuel pressure propagation-velocity "v" and the fuel supply passage length "L2".

$$M5=L2/v$$

In step S24 (response delay computing means), based on a specified time "M2" from the timing "t10" to the timing "t12" and the propagation delay time "M5", the computer computes a response delay time "M1" which corresponds to a time period from the timing "t10" to the timing "t11".

$$M1=M2-M5$$

In step S25, the response delay time "M1" computed in step S24 is updated and stored as a learning value. It should be noted that the response delay time "M1" may be stored in association with physical quantity (for example, fuel temperature and fuel property) which has high correlation with the fuel pressure propagation-velocity "v". The fuel temperature can be detected by a fuel temperature sensor, or can be estimated from the engine coolant temperature. The fuel property can be detected by an alcohol concentration sensor.

FIG. 5 is a flowchart showing a learning processing of the response delay time "M1". A response delay timing "N1" can be also learned in a similar manner as the response delay time "M1". That is, the fuel-pressure-increase-start timings "t22", "t23" is detected and the time difference "N4" therebetween can be computed.

Then, the fuel pressure propagation-velocity "v" is computed based on the difference in fuel passage length "L4−L2" and the time difference "N4", and a propagation delay time "N5" is computed.

$$N5=L2/v$$

The fuel pressure propagation-velocity "v" computed in step S22 may be used. Then, based on a specified time "N2" from the timing "t20" to the timing "t22" and the propagation delay time "M5", the computer computes a response delay time "N1" which corresponds to a time period from the timing "t20" to the timing "t21".

$$N1=N2-N5$$

The response delay time "N1" in closing the pressure reducing valve 43 and the response delay time "M1" in opening the pressure reducing valve 43 may be independently learned. Alternatively, only the response delay time "M1" may be learned. After the response delay times "M1", "N1" are learned, the thresholds "TH1", "TH2" are variably established according to the response delay times "M1", "N1".

For example, if the response delay times "M1", "N1" are longer than a specified reference time, the computer determines that a responsiveness of the pressure reducing valve 43 is deteriorated and corrects the thresholds "TH1", "TH2" in such a manner as to come close to the target common-rail pressure "Ptrg". Thereby, an overshoot of the actual common-rail pressure "Pact" can be reduced relative to the target common-rail pressure "Ptrg".

Meanwhile, if the response delay times "M1", "N1" are shorter than the specified reference time, the thresholds "TH1", "TH2" are corrected in such a manner as to be apart from the target common-rail pressure "Ptrg". Thereby, it can be restricted that the actual common-rail pressure "Pact" makes hunting phenomenon with respect to the target common-rail pressure "Ptrg".

According to the present embodiment described above, following advantages can be obtained.

(1) The fuel pressure variation timings "t12", "t22" are detected by use of the fuel pressure sensor 20 and the response delay times "M1","N1" are computed based on the timings "t12", "t22", "t10", and "t20". Thus, the response delay times "M1", "N1" of the pressure reducing valve 43 can be detected more accurately than a case where the response delay times "M1", "N1" are computed based on a fuel temperature, for example.

Based on the accurately computed response delay time "M1", "N1", the thresholds "TH1", "TH2" are variably established. Thus, the overshoot and the hunting of the actual common-rail pressure "Pact" are well restricted and the common-rail pressure can be accurately controlled in such a manner as to agree with the target common-rail pressure "Ptrg".

Since the response delay times "M1", "N1" are detected on board after the vehicle is shipped, even if the response delay times "M1", "N1" are varied due to the aging deterioration of the pressure reducing valve 43, the common-rail pressure can be accurately controlled in such a manner as to agree with the target common-rail pressure "Ptrg" more than a case where the common-rail pressure is controlled based on the response delay times which are obtained before the vehicle has been shipped.

(2) Since the fuel pressure variation timings "t12", "t13" are detected from a plurality of fuel pressure sensors 20 and the propagation-velocity "v" is computed based on its time difference "M4" to obtain the propagation delay time "M5", the propagation delay time "M5" can be obtained with high accuracy. Thus, the response delay time "M1" can be accurately computed by subtracting the "M5" from the "M2".

(3) Since the fuel pressure variation timings "t12", "t13" are detected by use of the pressure waveform which is used for computing the injection-rate waveform, the fuel pressure variation timings "t12" and "t13" can be accurately detected.

(4) The fuel pressure sensor 20 is provided to the fuel injector 10 and a variation in fuel pressure generated at a vicinity of the injection port 11*b* is detected by the fuel pressure sensor 20 before the variation in fuel pressure is attenuated in the common-rail 20. Thus, the fuel pressure variation timings "t12", "t13" can be detected with high accuracy. According to the present embodiment, since the fuel pressure variation timings "t12", "t13" are detected based on the detection values of the fuel pressure sensor 20 (#2, #4) which are provided to cylinders in which no fuel injection is conducted currently, the fuel pressure variation timings "t12", "t13" can be accurately detected based on the fuel pressure waveform which has no influence of the fuel injection, as shown in FIGS. 4D and 4E.

[Second Embodiment]

In the above first embodiment, the fuel pressure propagation-velocity "v" is computed based on the time difference "M4" between the timing "t12" and the timing 113", and the propagation delay time "M5" is computed based on the fuel pressure propagation-velocity "v". In the second embodiment, an estimated time "M5*a*" of the propagation delay time "M5" is previously stored. The response delay time "M1" is computed by subtracting the estimated time "M5*a*" from the specified time "M2".

Figure 6:
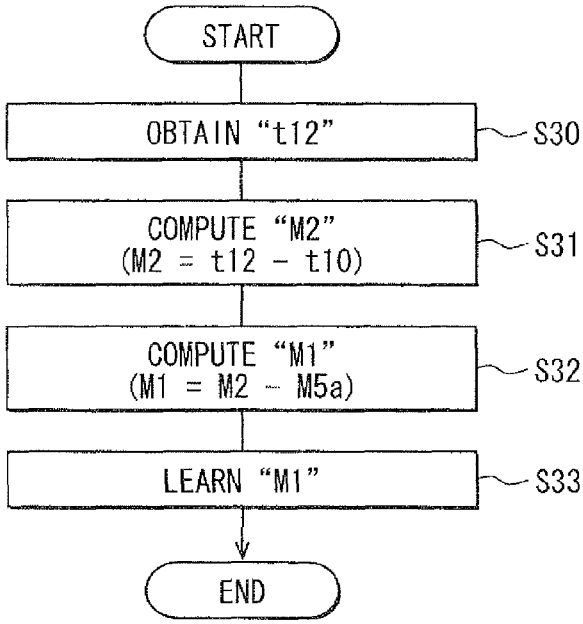
FIG. 6 is a flowchart showing a processing for computing the response delay time of the pressure reducing valve according to a second embodiment.

FIG. 6 is a flowchart showing a processing for computing the response delay times "M1" and "N1". The microcomputer of the ECU 30 repeatedly executes the processing at specified intervals.

In step S30 (fuel pressure variation detecting means), the computer obtains a pressure waveform of the detected fuel pressures "P(#2)" detected by the fuel pressure sensor 20 which is provided to a cylinder in which no fuel injection is currently conducted. Then, the fuel-pressure-decrease-start timings "t12", "t13" are detected. For example, the differentiation value of the fuel pressure waveform is computed. When a variation in the differentiation value exceeds a specified value, the current timing is detected as the fuel-pressure-decrease-start timing "t12" "t13".

In step S31, a time period "M2" from the timing 110" to the timing "t12" is computed.

$$M2=t12-t10$$

In step S32 (response delay computing means), the estimated time "M5*a*" is subtracted from the time "M2" to computes the response delay time "M1"

$$M1=M2-M5a$$

In step S33, the response delay time "M1" is updated and stored as a learning value.

FIG. 6 is a flowchart showing a learning processing of the response delay time "M1". A response delay timing "N1" can be also learned in a similar manner as the response delay time "M1". That is, the fuel-pressure-increase-start timings "t22", "t23" is detected. Then, based on a specified time "N2" from the timing "t20" to the timing "t22" and the estimated propagation delay time "N5*a*", the computer computes a response delay time "N1" which corresponds to a time period from the timing "t20" to the timing "t21".

$$N1=N2-N5a$$

The response delay time "N1" in closing the pressure reducing valve 43 and the response delay time "M1" in opening the pressure reducing valve 43 may be independently learned. Alternatively, only the response delay time "M1" may be learned. After the response delay times "M1", "N1" are learned, the thresholds "TH1", "TH2" are variably established according to the response delay times "M1", "N1".

Also in the second embodiment, since the fuel pressure variation timings "t12", "t22" are detected by the fuel pressure sensor 20 and the response delay times "M1", "N1" are computed based on the fuel pressure variation timings "t12", "t22" and the command timings "t10", "t20", the response delay times "M1" and "N1" can be accurately detected and the common-rail pressure can be accurately controlled in such a manner as to agree with the target common-rail pressure "Ptrg".

Further, according to the second embodiment, since the response delay time "M1" is computed based on the estimated propagation delay time "M5*a*", the computation load of the microcomputer can be reduced.

[Other Embodiment]

The present invention is not limited to the embodiments described above, but may be performed, for example, in the following manner. Further, the characteristic configuration of each embodiment can be combined.

The fuel pressure sensor 20 can be arranged at any place in a fuel supply passage between the common-rail 42 and the injection port 11*b* of the fuel injector 10. For example, the fuel pressure sensor 20 can be arranged in a high-pressure pipe 42*b* connecting the common-rail 42 and the fuel injector 10. Alternatively, the fuel pressure sensor 20 can be provided in the common-rail 42. The common rail 23 is provided with a pressure sensor 41. The common-rail 42, the high-pressure pipe 42*b* and the high-pressure passage 11*a* in the body 11 correspond to a fuel supply passage of the present invention.

In the above embodiments, the response delay time from the time when a command signal is outputted to the pressure reducing valve 43 until the time when the pressure reducing valve 43 is actually operated is detected based on the fuel pressure waveform detected by the fuel pressure sensor 20. Alternatively, a response delay time from the time when the command signal is outputted to the high-pressure pump 41 until the time when the high-pressure pump 41 actually discharge the fuel may be detected based on the fuel pressure waveform.

What is claimed is:

1. A controller for a pressure reducing valve applied to a fuel injection system which is provided with an accumulator accumulating a fuel which is supplied from a fuel pump to a fuel injector; a pressure reducing valve reducing an internal fuel pressure in the accumulator; and a fuel pressure sensor detecting a fuel pressure in a fuel supply passage from the accumulator to an injection port of the fuel injector, the controller controlling an operation of the pressure reducing valve in such a manner that the internal fuel pressure in the accumulator agrees with a target fuel pressure, the controller comprising:

a fuel-pressure-variation detecting means for detecting a fuel pressure variation timing at which a detection value of the fuel pressure sensor is varied due to an opening operation or a closing operation of the pressure reducing valve, and a response-delay-time computing means for computing a response delay time from a time when a command signal is outputted until a time when the pressure reducing valve start opening or closing, based on a command timing at which the command signal is outputted to open or close the pressure reducing valve and the fuel pressure variation timing detected by the fuel-pressure-variation detecting means, wherein the fuel pressure sensor is provided to a plurality of fuel supply passages of which path length are different from each other, the controller further comprising:

a time-difference computing means for computing a time difference between the fuel pressure variation timings detected by the fuel pressure sensors;

a propagation-velocity computing means for computing a fuel pressure propagation-velocity in the fuel supply passage based on the time difference; and a propagation-delay computing means for computing a propagation delay time from a time when the pressure reducing valve starts opening or closing until the time of the fuel pressure variation timing, wherein the response-delay-time computing means for computing the response delay time by subtracting the propagation delay time from a specified time which corresponds a time period from the command timing until the fuel pressure variation timing.

2. A controller for a pressure reducing valve according to claim 1, wherein the fuel pressure sensor is arranged downstream of an outlet of the accumulator with respect to a plurality of cylinder of a multi-cylinder engine, and the fuel-pressure-variation detecting means detects the fuel pressure variation timing based on a detection value of the fuel pressure sensor provided to a cylinder in which no fuel injection is currently conducted.

3. A controller for a pressure reducing valve applied to a fuel injection system which is provided with an accumulator accumulating a fuel which is supplied from a fuel pump to a fuel injector; a pressure reducing valve reducing an internal fuel pressure in the accumulator; and a fuel pressure sensor detecting a fuel pressure in a fuel supply passage from the accumulator to an injection port of the fuel injector, the controller controlling an operation of the pressure reducing valve in such a manner that the internal fuel pressure in the accumulator agrees with a target fuel pressure, the controller comprising:

a fuel-pressure-variation detecting means for detecting a fuel pressure variation timing at which a detection value of the fuel pressure sensor is varied due to an opening operation or a closing operation of the pressure reducing valve, and a response-delay-time computing means for computing a response delay time from a time when a command signal is outputted until a time when the pressure reducing valve start opening or closing, based on a command timing at which the command signal is outputted to open or close the pressure reducing valve and the fuel pressure variation timing detected by the fuel-pressure-variation detecting means, a means for establishing and storing an estimation time of a propagation delay time from a time when the pressure reducing valve starts opening or closing until the time of the fuel pressure variation timing, wherein the response-delay-time computing means for computing the response delay time by subtracting the estimation time of the propagation delay time from a specified time which corresponds a time period from the command timing until the fuel pressure variation timing.

4. A controller for a pressure reducing valve according to claim 3, wherein the fuel pressure sensor is arranged downstream of an outlet of the accumulator with respect to a plurality of cylinder of a multi-cylinder engine, and the fuel-pressure-variation detecting means detects the fuel pressure variation timing based on a detection value of the fuel pressure sensor provided to a cylinder in which no fuel injection is currently conducted.

5. A controller for a pressure reducing valve applied to a fuel injection system which is provided with an accumulator accumulating a fuel which is supplied from a fuel pump to a fuel injector; a pressure reducing valve reducing an internal fuel pressure in the accumulator; and a fuel pressure sensor detecting a fuel pressure in a fuel supply passage from the accumulator to an injection port of the fuel injector, the controller controlling an operation of the pressure reducing valve in such a manner that the internal fuel pressure in the accumulator agrees with a target fuel pressure, the controller comprising:

a fuel-pressure-variation detecting means for detecting a fuel pressure variation timing at which a detection value of the fuel pressure sensor is varied due to an opening operation or a closing operation of the pressure reducing valve, and a response-delay-time computing means for computing a response delay time from a time when a command signal is outputted until a time when the pressure reducing valve start opening or closing, based on a command timing at which the command signal is outputted to open or close the pressure reducing valve and the fuel pressure variation timing detected by the fuel-Pressure-variation detecting means, wherein the fuel pressure sensor is arranged downstream of an outlet of the accumulator, the controller further comprising:

a fuel-pressure-waveform generating means for generating a fuel pressure waveform indicative of a variation in the fuel pressure by obtaining a detection value of the fuel pressure sensor;

an injection-rate computing means for computing an injection-rate of during a fuel injection period based on the fuel pressure waveform, wherein a fuel-pressure-variation detecting means detects the fuel pressure variation timing by means of the fuel pressure waveform.

6. A controller for a pressure reducing valve according to claim 5, wherein the fuel pressure sensor is arranged downstream of an outlet of the accumulator with respect to a plurality of cylinder of a multi-cylinder engine, and the fuel-pressure-variation detecting means detects the fuel pressure variation timing based on a detection value of the fuel pressure sensor provided to a cylinder in which no fuel injection is currently conducted.

* * * * *